United States Patent [19]

Steidel

[11] Patent Number: 4,648,540

[45] Date of Patent: Mar. 10, 1987

[54] SIZE INDEPENDENT MODULAR WEB PROCESSING LINE AND MODULES

[76] Inventor: Leonard R. Steidel, 48 Monica Rd., Grand Island, N.Y. 14072

[21] Appl. No.: 695,963

[22] Filed: Jan. 29, 1985

Related U.S. Application Data

[63] Continuation-in-part of Ser. No. 675,149, Nov. 27, 1984, abandoned.

[51] Int. Cl.[4] ..... B65H 20/24

[52] U.S. Cl. ..... 226/111; 226/29; 364/469

[58] Field of Search ..... 226/24, 29, 108, 111; 364/468–474; 318/560, 579, 590, 625; 83/356.1–359, 479, 649, 650

[56] References Cited

U.S. PATENT DOCUMENTS

| | | | |
|---|---|---|---|
| 2,549,605 | 4/1951 | Huck . | |
| 3,468,201 | 9/1969 | Adamson et al. . | |
| 3,539,085 | 11/1970 | Anderson et al. | 226/25 |
| 3,561,654 | 2/1971 | Greiner | 226/25 |
| 3,763,360 | 10/1973 | Nishimura et al. | 235/151.11 |
| 4,257,103 | 3/1981 | Suzuki et al. | 364/474 |
| 4,406,389 | 9/1983 | Mowry, Jr. et al. | 226/29 |
| 4,464,615 | 8/1984 | Rodi | 316/625 |
| 4,473,009 | 9/1984 | Morgan | 226/40 X |
| 4,473,785 | 9/1984 | Kurakake | 318/560 |
| 4,484,522 | 11/1984 | Simeth | 226/28 X |
| 4,528,630 | 7/1985 | Sargent | 364/469 |

*Primary Examiner*—Leonard D. Christian

[57] ABSTRACT

A web processing line comprises a plurality of web processing modules operatively interconnected by intermodule bus. Each web processing module comprises a tool, tool drive, tractors and tractor drive. Microprocessors receive parameters from a control panel. Web movement is coordinated with tool movement by the microprocessors for web operations in variable locations on variable lengths of web.

15 Claims, 5 Drawing Figures

SIZE INDEPENDENT MODULAR WEB PROCESSING LINE AND MODULES

This application is a continuation-in-part of application Ser. No. 675,149, filed Nov. 27, 1984, abandoned.

BACKGROUND OF THE INVENTION

The present invention relates to web processing lines and units. More particularly, the invention is, in a principal aspect, a size independent modular web processing line of several web processing modules or units connected electronically in series or parallel. The modules are programmable to perform a plurality of operations of widely variable number and spacing in widely variable lengths of webs.

Processing operations are conducted on webs by web processing units having cylinders, rings or the like. These tools have work elements such as punches or knives which are rotated in contact with and operate on the webs. The work elements are fixed on the rings or cylinders in fixed patterns such that in the past, only one fixed pattern of web processing operations could be performed by any one cylinder or ring. To perform a different pattern of operations from that of a first cylinder or ring, gearing had to be changed or another cylinder or ring used. This entailed the change of gearing, the replacement of the first cylinder or ring and/or the use of additional cylinders or rings.

Mowry, Jr., et al. in U.S. Pat. No. 4,406,389 teach an advanced high speed web processing unit. The unit accommodates a variety of document lengths, web speeds, and tool impact locations. However, as in the past, the unit of Mowry, Jr., et al. is capable of only one pattern of operation. In Mowry, Jr., et al., the pattern consists of one impact per document.

SUMMARY OF THE INVENTION

In a principal aspect, the present invention is a size independent modular web processing line formed of several web processing modules. In another principal aspect, the invention is a web processing unit or module which is operable independently or electronically coupled with other identical units and other equipment.

Operating parameters are supplied by human operators via a control panel to internal electronics of the module. The operating parameters include the nature of the work to be performed, the number and placement of the contacts with the web, the web speed and if appropriate, lengths of any documents existing on the web.

Microprocessors receive the parameters input by the operator and compare the parameters with tables of web operating velocity profiles stored in memory. Signals to a tractor motor driving web tractors follow an operating velocity profile selected for the inputted parameters.

A tool is driven at substantially constant speed, while the tractors are accelerated, decelerated, stopped and started as dictated by the selected profile. The microprocessors use a reference pulse train and positional feedback from encoders to closely control the motion of the mechanical subsystems by comparing the actual motion to the desired motion of the selected profile and outputting appropriate signals to control the motors.

The module is capable of being electronically coupled with a plurality of duplicate modules and other equipment by an intermodule bus. Coupled modules are capable of operating in independent groups and speed-following existing machinery.

Modules electronically coupled together and with other equipment can perform different functions in an independent and yet coordinated manner. For example, one module can have several cutting operations, such as perfing and punching, and another module can have several numbering operations, with each module programmed to perform its respective function only, yet synchronized with the other module as to overall web throughput. Several examples of functions which can be performed by the module include folding, gluing, and printing. Numerous other web working functions can be performed.

Each web processing module operates mechanically independently of each of the other modules and any other equipment. Each follows the digitized pulse train supplied through the intermodule bus by a master unit. Thus, a perturbation in the mechanics of one unit will not affect the operation of any other unit. Operation is, however, coordinated.

As desired, no one module need be the master. Operating parameters of all modules can be simultaneously altered from one or more individual modules in a group. Thus, operating commands from one module can control all the modules in the cluster, and no one module is the master.

Those in the art will appreciate that the invention is an exciting advance in the art. The invented modules provide the ability to configure rapidly variable web processing lines of modules, and the ability to expand a line without the physical problems associated with fixed in-line equipment. The line and modules are size independent. Modules may be placed on casters or the like, and a line created by simply wheeling modules into position, plugging them together, and positioning web to be processed across the modules in loose loop fashion. Any malfunctioning module can be quickly wheeled from the line and replaced. A new line may be created by unplugging unwanted modules and wheeling them away, wheeling and plugging in any desired additional modules, and wheeling the modules into any desired order. A user may begin with one or a few modules and add modules anytime desired. The modules should find application in sales offices, electronic printing ventures, and warehouse form processing installations.

Form depths (lengths) are no longer a significant constraint. Utilizing modules to create forms, forms of any desired depth are possible without change of gearing, rings or the like. Specialized form depths are readily produced without change of equipment from the equipment utilized for any single, standard form depth.

The invention and its advantages will be most fully appreciated from a reading of the detailed description of the preferred embodiment, which follows.

DETAILED DESCRIPTION OF THE PREFERRED EMBODIMENT

Figure 1:
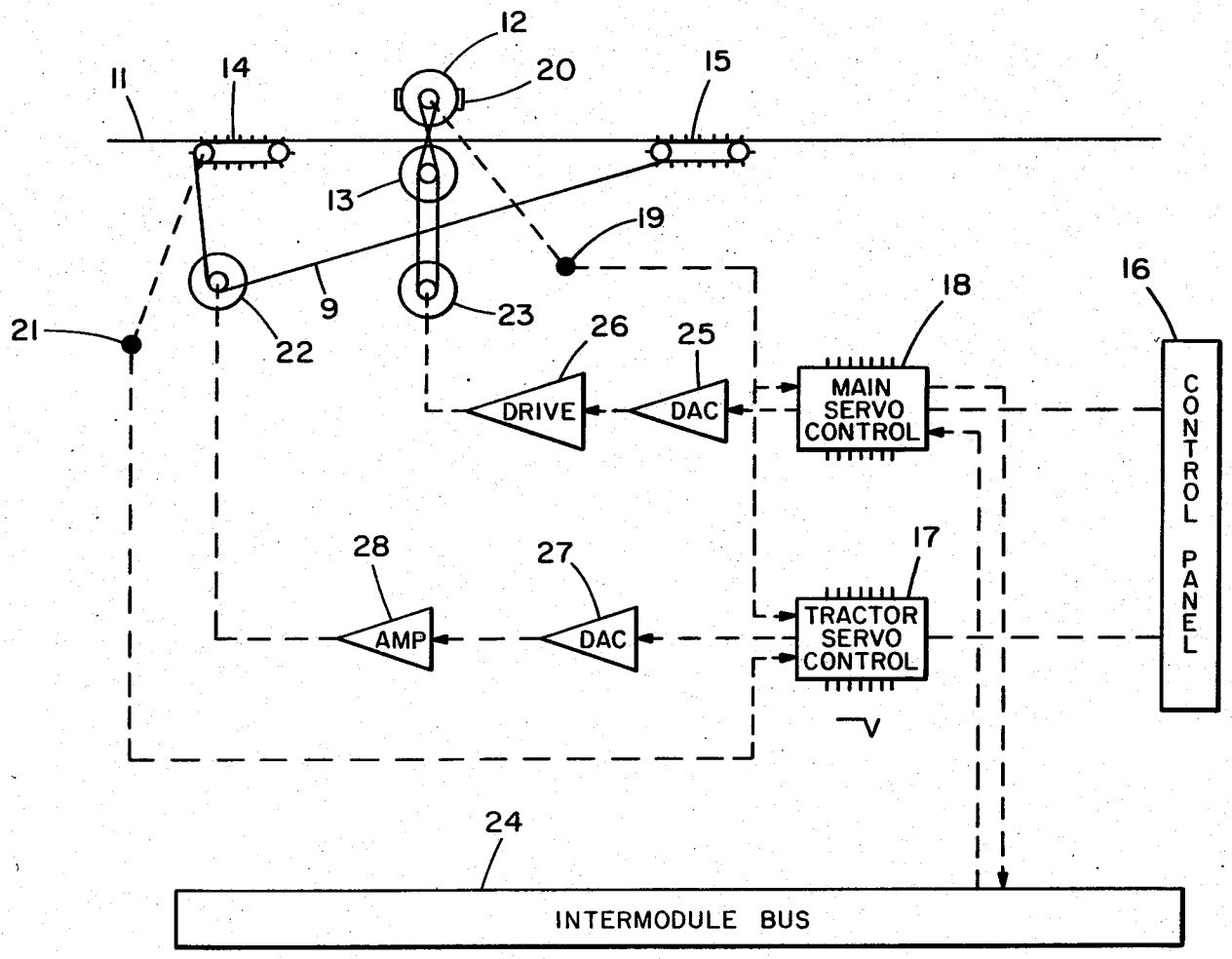
FIG. 1 is a block diagram of the web processing module which is the preferred embodiment of the invention.

Referring to FIG. 1, the preferred embodiment of the invention is a web processing module 10. The module includes tool means for performing a web processing operation, such as a tool being an impression tool 12. The tool 12 works on a web 11 against a backing roll 13. Web conveying means such as pairs of tractors 14, 15 engage and move or convey the web 11 past the tool means such as the tool 12.

The tool 12 and roll 13 are driven by a tool drive means for driving the tool means such as a tool drive motor 23. The drive motor 23 is operatively connected to the tool 12. The tractors are driven by a web conveying drive means such as a tractor drive being a tractor drive motor 22 and drive linkage 9. The linkage 9 mechanically links the tractors 14, 15 and the tractor drive motor 22. The motors 23, 22 are D.C. motors. Motor 23 is energized through an operatively connected drive 26, while motor 22 is energized through an operatively connected amplifier 28. Both the drive 26 and amplifier 28 receive electrical input from operatively connected digital to analog converters (DAC's), respectively 25, 27.

Electronic, digital computer control means such as microprocessor systems 17, 18 control the module 10. Both are Intel 8088 microprocessors. As labelled, the microprocessor system 18 is the Main Servo Control, operatively electronically connected to and controlling the drive 26, which is considered the main servomechanism. System 17, the Tractor Servo Control, is operatively, electronically connected to the amplifier 28, and controls the amplifier 28. System 18 thereby controls the tool drive motor 23, and the tool 12. System 17 controls the tractor drive motor 22 and the tractors 14, 15.

Both microprocessor systems 17, 18 receive tool positional information from the tool 12 through an operatively connected tool positional information generating means such as a tool encoder 19. System 17 receives web positional information from the tractors 14, 15 through an operatively connected web positional information generating means such as a tractor encoder 21. The tool encoder 19 reports the position of the tool 12, and has a resolution of approximately 12 pulses of output per inch of linear displacement of the surface of roll 12. The tractor encoder 21 has a resolution of approximately 480 output pulses per inch of web displacement. The system 18 utilizes information from the tool encoder 19 as feedback to accurately control the tool 12. System 17 utilizes information from the tool encoder 19 for coordinating motion of the tractors 14, 15 to the tool 12. System 17 utilizes information from the encoder 21 as feedback to accurately control the tractors 14, 15.

Microprocessor system 18 includes a variable-frequency pulse generator (not shown). The pulse generator sends pulse signals through an intermodule bus 24 back to the system 18. The frequency of the pulses is proportional to the desired rotational speed of the tool.

The desired motion of the tool 12 is rotation at a constant angular velocity. Each pulse which is received from the intermodule bus 24 represents one pulse worth of angular displacement from the tool feedback encoder 19. The output from microprocessor system 18 to DAC 25, which subsequently controls drive 26 and motor 23, is a value which causes the motion of the tool 13 to correct for any instantaneous rotational position errors of the tool. In short, every time a pulse is received from the intermodule bus 24, a pulse is expected as tool positional feedback from encoder 19.

As the tool 12 turns, tool position is read by the encoder 19. The microprocessor system 17 includes an erasable programmable memory (EPROM). Stored in EPROM in system 17 is information sufficient to accurately control the tractors 14, 15 to coordinate with the tool 12. Information is present sufficient to coordinate the tractors 14, 15 to the tool 12 such that work can be done on the web 11 in a variety of patterns. This information takes the most preferred form of a series of web velocity profiles stored in a compressed fashion. Each stored profile represents the web motion required to produce a given distance between tool impacts on the web. Stored compressed profile tables are combined and expanded into a "working" profile table in RAM (random access memory) according to the information input by the operator as to the pattern of tool impacts desired in one repeat length. Repeat length is, by definition, one cycle through the working profile table, or one repeat of the desired pattern of impacts. The working profile table provides both reference displacements and reference velocities for the web in relation to the displacement of the tool assembly. The values stored in the tables are tractor displacements necessary to work patterns for each pulse, i.e., each 1/12 inch of movement of the tool surface.

The desired movement of tractors 14, 15 is movement according to a desired velocity profile. Actual profile table values are base values which represent the desired web displacement for one pulse from tool encoder 19. A "raw" DAC value is calculated from the frequency of pulses from tool encoder 19. A desired displacement is calculated by altering the desired displacement from the profile table with a position error value derived from a comparison of actual position, from encoder 21, and desired position. The "raw" DAC value is then multiplied by the desired web displacement to provide avalue output to DAC 27 appropriate to cause the proper instantaneous web velocity. These calculations are performed in microprocessor system 17 every time a pulse is received from encoder 19. Accurate control of the tractors 14, 15 is thus provided.

The microprocessor systems 17 and 18 are commanded through the control panel 16. Panel 16 accepts from a human operator a range of values for several operating parameters. The values are selected by the operator. The parameters include desired overall web velocity, or throughput; lengths of documents on the web, if any; the number and location of desired web processing operations; and the desired frequency of repetition of the desired web processing operations, in terms of length of web, number of documents or the like.

Parameters input through the control panel 16 are evaluated by the microprocessor systems 17, 18. With the inputted parameters, the microprocessor system 17 automatically selects web velocity profile tables suited to the desired parameters.

The preferred embodiment of the invention is now described. As a specific example of the invention and the preferred embodiment, the tool 12 may be an impression roll 38 with numbering heads 40, 41, as in FIG.

3. The heads 40, 41 are 180° apart around the circumference of the roll 38 and are on opposite ends of the roll 38 longitudinally.

Figure 4:
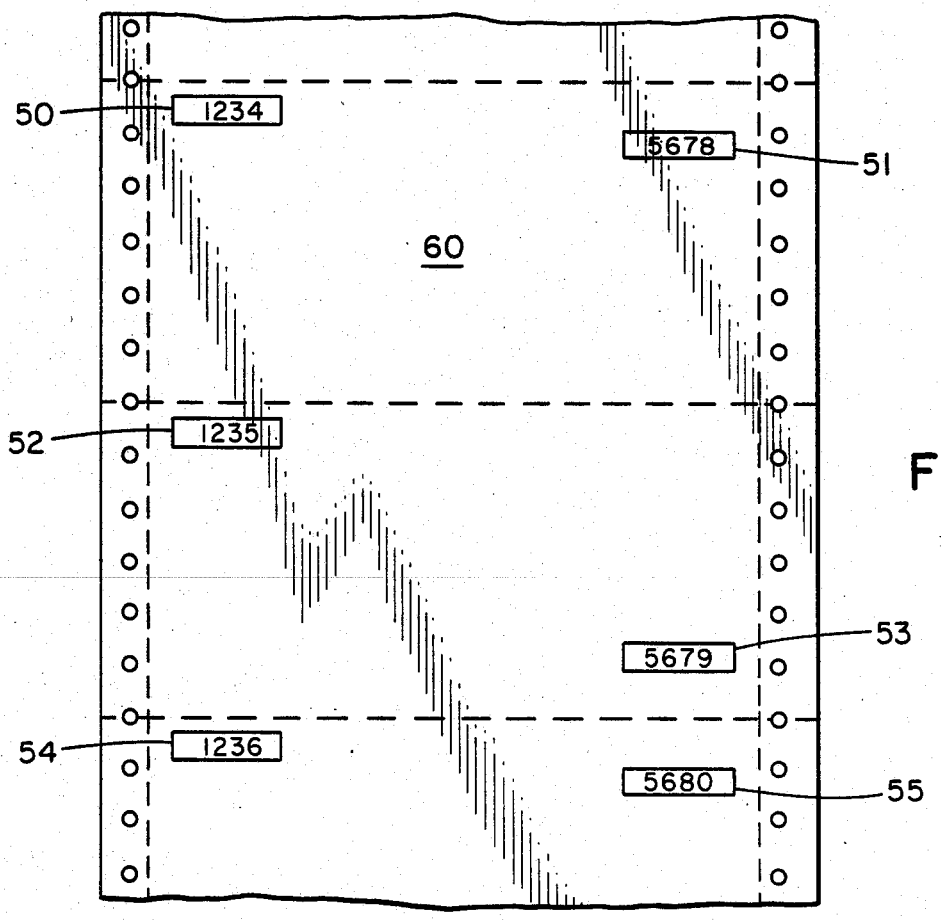
FIG. 4 is a diagram of a web printed with the impression roll of FIG. 3 and with a desired pattern.

A web 60, as in FIG. 4, is numbered by the roll 38 in a module 10. The pattern of numbering is as selected by the operator. The pattern includes a repeat length equal to two form depths, and the following numbering: numbering 50 at the beginning of the repeat length by numbering head 40; numbering 51 by head 41 immediately thereafter; numbering 52 by head 40 at the midpoint of the repeat length; and numbering 53 near the end of the repeat length by head 41. In a successive repeat length, numbering continues as at 54, 55. Spacing is constant between the numberings 50, 52, etc. by the head 40. Spacing is varied between the numberings 51, 53, etc.

Figure 5:
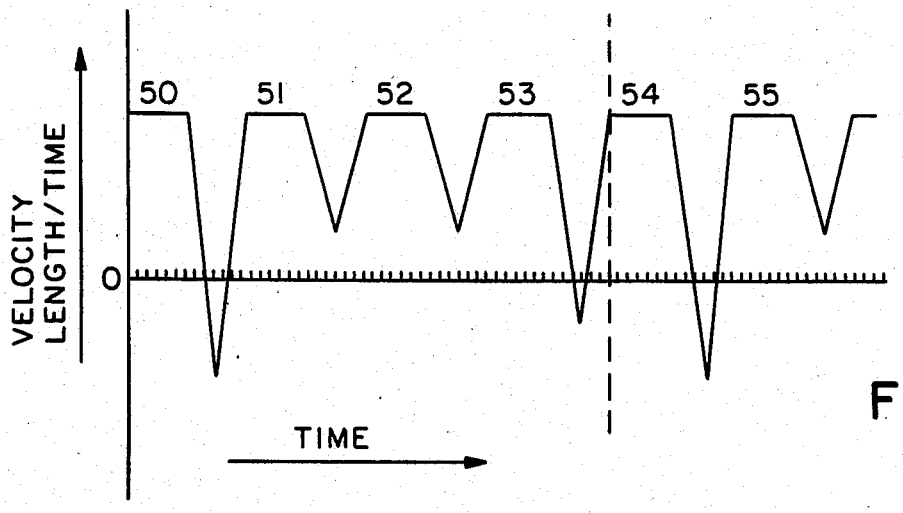
FIG. 5 is a graphical representation of the velocity profile for the printed web of FIG. 4.

The module 10 generates a working profile table as graphically represented in FIG. 5. Numberings 50, 51, 52, 53 occur while the web is moved at constant velocity. Between all numberings the web is decelerated and then accelerated to achieve the desired spacing. Between numberings 50, 51, numberings 53, 54 and repetitions, the web is not only decelerated but also driven briefly in reverse before being accelerated, to achieve the close spacing between numberings 50, 51; 53, 54; and repetitions.

Figure 2:
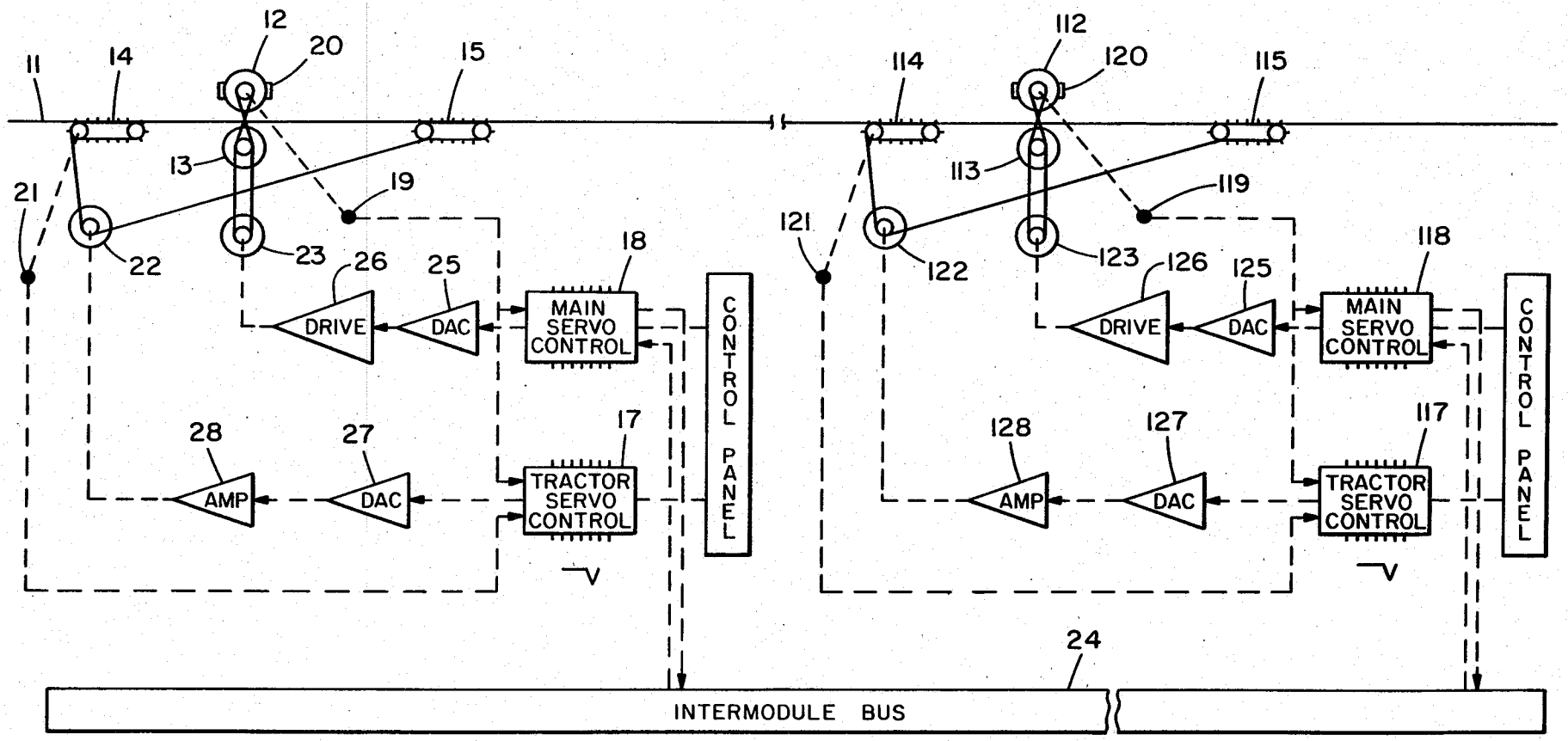
FIG. 2 is a block diagram of two of the preferred web processing modules coupled together.
Figure 3:
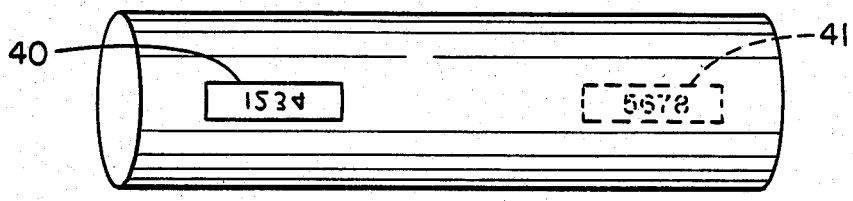
FIG. 3 is a diagram of one embodiment of the tool of the module, in the form of a roll with two numbering heads on the opposite sides of the roll.

A pair of modules 10 is shown connected in tandem at FIG. 2. The upstream module includes reference numerals as in FIG. 1 while the downstream module includes similar reference numerals but incremented by 100. Both modules have their main servo control circuits connected to the intermodule bus 24.

The preferred embodiment constitutes the best mode contemplated by the inventor of carrying out the invention. The invention, and the manner and process of making and using it, have been described in full, clear, concise and exact terms to enable any person skilled in the art to make and use the same. Because the invention may be copied without the copying of the precise details of the preferred embodiment, the following claims particularly point out and distinctly claim the subject matter which the inventor regards as his invention and wishes to protect.

What is claimed is:

1. A web processing module capable of performing a web processing operation in variable spaced locations on the web, said module comprising:
   - a tool for performing a web processing operation on the web;
   - tool drive means for driving the tool;
   - conveying means for conveying the web past the tool;
   - web drive means for driving the conveying means; and
   - electronic control means for electrically controlling the tool drive means and the web drive means to coordinate the conveying means to the tool over a range of variably spaced web processing operation locations on the web.

2. A web processiwng module as in claim 1 in which the control means constitutes digital computer control means.

3. A web processing module as in claim 1 in which the control means constitutes microprocessor control means.

4. A web processing module as in claim 1 in which the control means includes a main servo control loop for controlling the tool drive means and a web servo control loop for controlling the web drive means, said loops being electrically linked for coordination therebetween.

5. A web processing module as in claim 1 in which the control means includes control panel means for receiving manually input parameters defining web processing operation locations at variably spaced apart lengths of web.

6. A web processing module as in claim 4 further comprising:
   - first encoder means for generating tool position information representing the tool position;
   - second encoder means for generating web position information representing the web position;
   - the module being one in which the main servo control loop and said web servo control loop are each connected to receive said tool positional information and said web servo control loop is also connected to receive said web position information.

7. A web processing module as in claim 6 in which the means for generating tool positional information constitutes a tool encoder, and the means for generating web positional information constitutes a web drive encoder.

8. A web processing module as in claim 1 in which the conveying means comprises tractors and the web drive means comprises a tractor drive.

9. A web processing module as in claim 8 in which the tractor drive includes a tractor drive motor and drive linkage mechanically linking the tractors and the tractor drive motor.

10. A web processing module as in claim 1 in which the tool drive means includes a tool drive motor operatively connected to the tool.

11. A web processing module capable of performing a web processing operation in variable locations on variable lengths of web comprising:
   - a tool means for performing a web processing operation on the web;
   - tool drive means for driving the tool means;
   - web conveying means for conveying the web past the tool means;
   - web conveying drive means for driving the web conveying means;
   - control means for controlling the tool drive means and the web conveying means to coordinate the web conveying means to the tool means over a range of variable web processing operation locations and a range of variable lengths of web and
   - in which the tool means constitutes a tool, the tool drive means includes an electrical tool drive motor operatively connected to the tool, the web conveying means constitutes tractors, the web conveying drive means includes a tractor drive motor and a drive linkage operatively connecting the tractors and the tractor drive motor,
   - the module further comprising a tool encoder for generating tool positional information and a web tractor encoder for generating web positional information,
   - and further in which the control means constitutes an electronic, digital, computer controller electronically, operatively connected to the tool drive motor, the tractor drive motor, the tool encoder and the tractor encoder,
   - the controller including a control panel, an intermodule bus, a main servo control microprocessor system and a tractor servo control microprocessor system, the tractor servo control microprocessor system including memory with information to coordinate the tractors with the tool such that the web processing operations can be performed in the variable locations on the variable lengths of web, the control panel accepting manually input operating parameters including web throughput, number and locations of desired web processing operations, and desired web length of repetition of the desired web processing operations, the tractor servo control microprocessor generating, from the information in memory, profiles for control of the tractors according to the manually input operating parameters, the main servo control microprocessor system and the tractor servo control microprocessor system receiving tool positional information from the tool encoder, the tractor servo control microprocessor system receiving web positional information from the tractor encoder, the main servo control microprocessor utilizing the tool positional information as feedback to accurately control the tool, the tractor servo control microprocessor utilizing the web positional information as feedback to accurately control the tractors, and the tractor servo control microprocessor utilizing the tool positional information for coordinating the movement of the tractors to the movement of the tool.

12. A web processing module as in claim 11 in which the tractor servo control microprocessor includes means for storing in memory a series of web velocity profiles and means for selecting profiles according to the manually input operating parameters.

13. A web processing line comprising:

a plurality of self-contained web processing modules, each capable of performing a web processing operation at locations spaced apart by variable lengths of web, and an intermodule bus electronically operatively connecting the modules so as to drive their respective tools synchronously with respect to one another.

14. A web processing line comprising a plurality of web processing modules each capable of performing a web processing operation in variable locations on variable lengths of web, and an intermodule bus electronically operatively connecting the modules, in which each module comprises:

a tool means for performing a web processing operation on the web;

tool drive means for driving the tool means;

web conveying means for conveying the web past the tool means;

web conveying drive means for driving the web conveying means; and control means for controlling the tool drive means and the web conveying means to coordinate the web conveying means to the tool means over a range of variable web processing operation locations and a range of variable lengths of web.

15. A web processing line comprising a plurality of web processing modules each capable of performing a web processing operation in variable locations on variable lengths of web, and an intermodule bus electronically operatively connecting the modules, in which at least one module includes a control panel operatively connected via the intermodule bus to all modules, whereby the control panel is capable of receiving parameters for setting operation of all modules.

* * * * *

UNITED STATES PATENT OFFICE

CERTIFICATE OF CORRECTION

PATENT NO. : 4,648,540

DATED : Mar. 10, 1987

INVENTOR(S) : LEONARD R. STEIDEL

It is certified that error appears in the above-identified patent and that said Letters Patent are hereby corrected as shown below:

On the title page the following should be inserted:

[73] Assignee: Moore Business Forms, Inc.
Grand Island, New York

Signed and Sealed this

Fifteenth Day of December, 1987

*Attest:*

DONALD J. QUIGG

*Attesting Officer*

*Commissioner of Patents and Trademarks*